US006659927B2

(12) United States Patent
Myers et al.

(10) Patent No.: US 6,659,927 B2
(45) Date of Patent: Dec. 9, 2003

(54) FOLDING PRESSER ASSEMBLY

(75) Inventors: Rick D. Myers, Conyers, GA (US); David J. Coursey, Conyers, GA (US)

(73) Assignee: SDC Innovations, Inc., Decatur, GA (US)

( * ) Notice: Subject to any disclaimer, the term of this patent is extended or adjusted under 35 U.S.C. 154(b) by 150 days.

(21) Appl. No.: 09/845,677

(22) Filed: Apr. 30, 2001

(65) Prior Publication Data

US 2002/0160898 A1 Oct. 31, 2002

(51) Int. Cl.[7] ..... B21B 1/74

(52) U.S. Cl. ..... 493/83; 493/373; 493/468; 493/478; 493/479

(58) Field of Search ..... 493/82, 83, 373, 493/468, 475, 478, 479; 225/105, 104, 103; 254/122, 126, 124; 269/289 R; 100/266, 283

(56) References Cited

U.S. PATENT DOCUMENTS

| | | | | |
|---|---|---|---|---|
| 707,803 A | | 8/1902 | Smith | 269/214 |
| 1,260,345 A | | 3/1918 | Dies | 24/569 |
| 1,414,354 A | | 5/1922 | Gibbs | 269/250 |
| 3,107,716 A | | 10/1963 | Wehmeyer | 72/308 |
| 3,782,166 A | | 1/1974 | Whistler et al. | 72/462 |
| 4,452,595 A | | 6/1984 | Huff | 493/373 |
| 4,921,154 A | | 5/1990 | Abe et al. | 225/97 |
| 5,049,122 A | * | 9/1991 | Marschke | 493/373 |
| 5,087,236 A | | 2/1992 | Morimoto | 493/373 |
| 5,100,040 A | * | 3/1992 | Kunreuther et al. | 225/105 |
| 5,156,584 A | | 10/1992 | Cohen et al. | 493/472 |
| 5,178,600 A | | 1/1993 | Harder | 493/162 |
| 5,179,882 A | | 1/1993 | Takeuchi et al. | 83/125 |
| 5,222,717 A | * | 6/1993 | Traficant | 254/122 |
| 5,474,219 A | | 12/1995 | Mano | 493/373 |
| 5,529,565 A | | 6/1996 | Oetlinger | 493/468 |
| 5,599,269 A | | 2/1997 | Oetlinger | 493/468 |
| 5,605,527 A | | 2/1997 | Gillieron | 493/342 |
| 5,735,442 A | | 4/1998 | Emrich | 225/1 |
| 5,766,123 A | | 6/1998 | Oetlinger | 493/468 |
| 5,810,233 A | | 9/1998 | Varidel | 225/97 |
| 5,893,825 A | | 4/1999 | Rebeaud | 493/468 |
| 5,971,378 A | | 10/1999 | Sweeney | 269/6 |
| 6,045,122 A | * | 4/2000 | Torres | 254/122 |

* cited by examiner

*Primary Examiner*—Stephen F. Gerrity
*Assistant Examiner*—Michelle Lopez
(74) *Attorney, Agent, or Firm*—Kilyk & Bowersox, P.L.L.C.

(57) ABSTRACT

A presser assembly for supporting blanking scrap during a blanking operation is provided. The presser assembly includes a support rail; a presser rail connected to the support rail; and a connecting rail connecting the presser rail to the support rail and being adapted to pivot with respect to at least one of the support rail and the presser rail through a predetermined pivot angle range for changing a distance between the support rail and the presser rail. By pivoting, one can thereby selectively affect a folding and an unfolding of the presser assembly during a blanking operation.

27 Claims, 3 Drawing Sheets

FOLDING PRESSER ASSEMBLY

BACKGROUND OF THE INVENTION

1. Technical Field of the Invention

This invention generally relates to a presser assembly for a blanking operation, and, more particularly, to a presser assembly for supporting blanking scrap, such as carton or paper blanking scrap during a blanking operation.

2. Description of Related Art

In the manufacture of cartons and paper products, small sheets of material are typically cut out of larger sheets. These smaller sheets are known as blanks that, in turn, may be further formed into various shapes, such as, by way of example, into boxes. The blanks are formed during a process known as a blanking operation. In a blanking operation, the blanks are cut, but not removed, from the large sheet of carton or paper material. After the blanks have been cut, the sheet is positioned over a frame for support. The frame typically includes large openings that correspond in size and in position to the blanks previously cut. Below the frame is a mechanism for stacking the blanks. In order to knock the carton blanks from the sheet of material and hold the scrap material, what is known in the art as a presser assembly is used. The presser assembly includes a support tool having a presser member and a presser rail depending therefrom. The presser rail is biased away from the support tool. As the support tool is lowered, the presser rail engages the sheet of material such that the sheet of material is secured between the presser rail and the frame. The support tool continues to be lowered such that the presser member engages the blanks and knocks the blank out of the sheet of material. The carton blanks fall onto a stacking mechanism wherein the blanks are stacked.

If the presser rail does not adequately hold the blanking scrap, the scrap may fall onto the stacking mechanism. A carton blanking scrap in the stacking mechanism may jam the mechanism thereby causing downtime and expense. In order to securely hold the carton blank scrap, the present day presser rails are interconnected to the support tool by a plurality of guide cylinders. Each guide cylinder biases the presser rail away from the support tool. This gives the presser rail a certain amount of flexibility when engaging the carton blanking scrap. However, even with this limited flexibility, present day presser rails and assemblies have been found to be inadequate and require substantial assembly and various parts. An example of such a presser assembly is provided in U.S. Pat. No. 5,529,565, the subject matter of which is incorporated herein in its entirety by reference.

The prior art fails to provide a presser assembly that offers a simple configuration which is less costly to manufacture and easier to assemble, and which is further easily and efficiently mountable to a backer board of a blanking device.

SUMMARY OF THE INVENTION

It is a purpose of the present invention to solve the above-mentioned problems.

To achieve the above purpose, the present invention provides a presser assembly for supporting blanking scrap during a blanking operation. The presser assembly includes: a support rail; a presser rail connected to the support rail; and a connecting rail connecting the presser rail to the support rail and being adapted to pivot with respect to at least one of the support rail and the presser rail through a predetermined pivot angle range. The pivot angle range is for changing a distance between the support rail and the presser rail to thereby selectively affect a folding and an unfolding of the presser assembly during the blanking operation.

The present invention further encompasses a kit for forming a presser assembly for supporting blanking scrap during a blanking operation. The kit includes: a support rail; a presser rail adapted to be connected to the support rail; and a connecting rail adapted to connect the presser rail to the support rail and adapted to pivot with respect to at least one of the support rail and the presser rail in an assembled state of the presser assembly. The pivoting is through a predetermined pivot angle range for changing a distance between the support rail and the presser rail thereby selectively effecting a folding and an unfolding of the presser assembly during the blanking operation.

Additionally, the present invention provides a method of using the presser assembly described above. The method comprises the steps of: pivoting the connecting rail with respect to at least one of the support rail and the presser rail for reducing an angle defined therebetween thereby folding the presser assembly for reducing a distance between the presser rail and the support rail; and pivoting the connecting rail with respect to at least one of the support rail and the presser rail for increasing an angle defined therebetween thereby unfolding the presser assembly for increasing a distance between the presser rail and the support rail.

Moreover, the present invention provides a presser assembly for supporting blanking scrap during a blanking operation, where the presser assembly includes: a support means; a presser means connected to the support means and supported thereby; and a connecting means for connecting the presser rail to the support rail and being adapted to pivot with respect to the presser rail through a predetermined pivot angle range for changing a distance between the presser rail and the support rail thereby selectively affecting a folding and an unfolding of the presser assembly during the blanking operation.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description. dr

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE PREFERRED EMBODIMENTS

The present invention overcomes the problems of the prior art by providing a presser assembly of simple construction having fewer components than presser assemblies of the prior art which use guide cylinders. The presser assembly of the present invention therefore tends to advantageously be less costly to manufacture and easier to assemble. The presser assembly according to the present invention is further, in an advantageously manner, easily and efficiently mountable to a backer board of a blanking device.

In order to achieve the above advantages, the present invention provides a presser assembly that includes at least one, and preferably two, connecting rails between a support rail and a presser rail. The connecting rail establishes and maintains a distance between the support rail and the presser rail, and is advantageously pivotable with respect to at least one of the support rail and the presser rail for allowing the presser assembly to be folded and unfolded thereby reducing a distance between the support rail and the presser rail. An unfolding of the presser assembly would then involve a pivoting of the connecting rail with respect to at least one of the support rail and the presser rail such that a distance between the support rail and the presser rail is increased. The ability to decrease and increase the distance between the support rail and the presser rail, as recognizable by one skilled in the art, advantageously allows an expedient blanking operation to take place. The fact of using at least one, and preferably two connecting rails according to the present invention greatly simplifies the construction of a presser assembly and makes assembly and mounting of the presser assembly simpler and more efficient.

By "rail," what is meant in the context of the present invention is any rigid member the length of which does not vary during a folding and unfolding of the presser assembly. Furthermore, a distance between the support rail and the presser rail may be "changed" according to the present invention by moving the support rail and the presser rail with respect to one another in either a translational movement and/or a pivoting movement of the support rail with respect to the presser rail. In either case, a distance between the support rail and the presser rail is changed. In addition, by "folding" the presser assembly, what is meant in the context of the present invention is a pivoting of parts of the presser assembly with respect to one another to draw the parts together and to make the assembly more compact.

Figure 1:
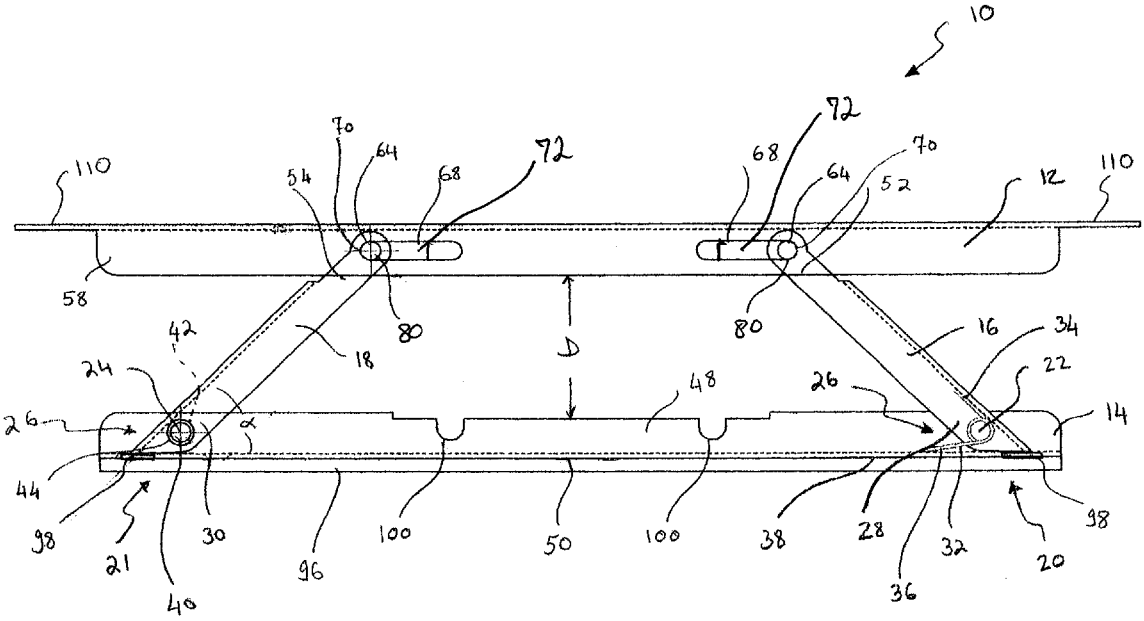
FIG. 1 is a front-elevational view of a preferred embodiment of a presser assembly according to the present invention.

Turning now to the drawings, and more particularly, to FIG. 1, a preferred embodiment of the present invention is shown. As seen in FIG. 1, the preferred embodiment includes a presser assembly 10 for supporting blanking scrap during a blanking operation. Presser assembly 10 includes a support rail 12 and a presser rail 14 connected to the support rail as shown. At least one, and preferably two, connecting rails 16, 18 connect the presser rail 14 to the support rail 12. In the shown preferred embodiment of the present invention, a first connecting rail 16 and a second connecting rail 18 connect the presser rail 14 to the support rail 12 respectively at the first end 20 and at the second end 21 of the presser rail 14. The first connecting rail 16 and the second connecting rail 18 each are adapted to independently pivot with respect to at least one of the support rail 12 and the presser rail 14 for changing a distance between the support rail and the presser rail thereby enabling folding the presser assembly during the blanking operation. In the shown preferred embodiment, the first connecting rail 16 and the second connecting rail 18 are pivotable with respect to presser rail 14 at respective pivot points 22 and 24 as shown. The support rail 12 and the presser rail 14 are biased away from one another by a biasing mechanism 26. The biasing mechanism as shown is coupled to presser ends 28 and 30 of the first connecting rail 16 and the second connecting rail 18, respectively. However, it is to be understood that the present invention includes within its scope a biasing mechanism that is coupled to at least one of two ends of one or more connecting rails connecting the support rail with the presser rail. In the preferred embodiment of the present invention, the biasing mechanism 26 comprises a torsion spring 32, shown in phantom in FIG. 1, at only the presser end of the first connecting rail 16, it being understood that a torsion spring (not shown) is also provided at presser end 30. Each torsion spring includes a distal arm 34 and a proximal arm 36, the distal arm 34 resting against a corresponding one of the first connecting rail 16, there being a similar arrangement for the second connecting rail 18. The proximal arm 36 rests against a trough 38 of the presser rail 14. Each torsion spring 32 in this way biases the corresponding connecting rail to establish, with other separation limiting means, a default distance D between the support rail 12 and the presser rail 14, the connecting rails in this way defining an angle a between each connecting rail and the presser bar. The angle $\alpha$ at the default distance is preferably from about 30° to about 60°, for example, from about 40° to about 50°. More preferably, the angle $\alpha$ is about 45 degrees. As shown in FIG. 1, the connecting rails, presser rail, support rail, and the presser assembly are in their default modes, or positions.

Preferably, according to the present invention, biasing mechanisms 26 further each include a first pin 40, only one of which is depicted in FIG. 1, each one respectively extending through a respective presser end 28 or 30 of the first connecting rail 16 and the second connecting rail 18 for pivotally securing the first connecting rail and the second connecting rail to the presser rail. While only one pin 40 is shown in FIG. 1, it is to be understood that there is a pin 40 provided to secure the torsion spring 32 to each presser end of each of the first connecting rail 16 and the second connecting rail 18. The pin 40 preferably extends through holes 42 in each of the presser ends 28 and 30, and through corresponding holes 44 at the first end 20 and second end 21 of the presser rail 14. It is to be understood that, similar to pin 40, although only one series of holes 40 and 42 are shown in FIG. 1, identical holes are provided at both the first end 20 and the second end 21 of the presser rail 14, and at both presser ends 28 and 30 corresponding to both connecting rails 16 and 18.

Figure 2:
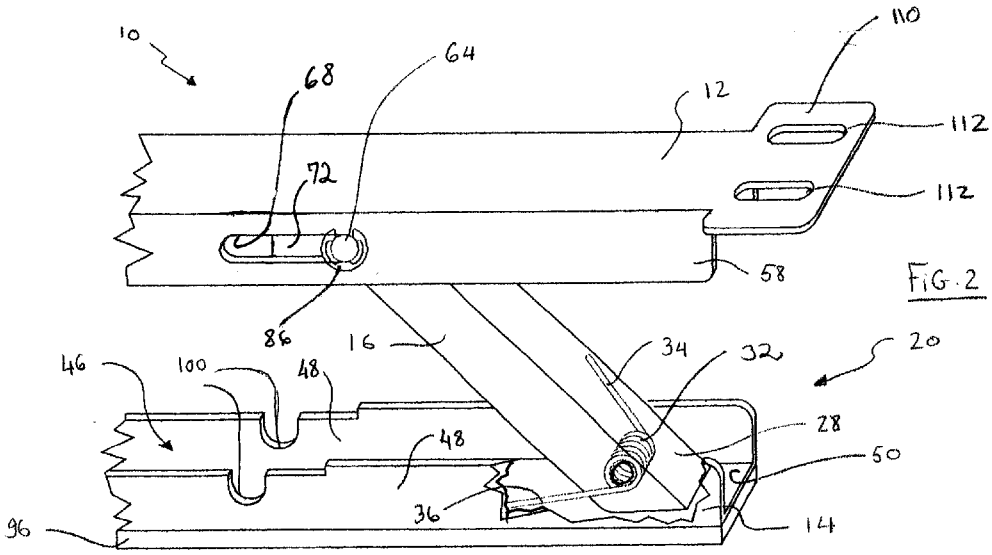
FIG. 2 is a perspective, partially cut-away portion of the presser assembly according to FIG. 1 showing a biasing mechanism according to a preferred embodiment of the present invention.

Referring now to FIG. 2, a perspective view is provided of the presser assembly of FIG. 1 in its default mode showing a portion thereof adjacent the first end 20 of presser rail 14. It is to be understood, however, that, according to the preferred embodiment of the present invention, each end of the presser assembly is identical to or a mirror image of the other end thereof. Therefore, descriptions regarding FIG. 2 and pertaining to portions of the presser assembly adjacent first end 20 of presser rail 14 apply equally to the portions of the presser assembly adjacent second end 21 of presser rail 18. As shown in FIG. 2, the presser rail is preferably an elongated member defining a trough 46 therein. The trough is more preferably defined between two parallel sidewalls 48 and a bottom wall 50, presser ends 28 and 30 resting against bottom wall 50, and proximal arm 26 of torsion spring 32 further resting against bottom wall 50. Referring back to FIG. 1, the first connecting rail 16 and the second connecting rail 18 each further have respective support ends 52 and 54 and are further pivotally connected to the presser rail such that presser ends 28 and 30 thereof are disposed in the trough 46.

Figure 3:
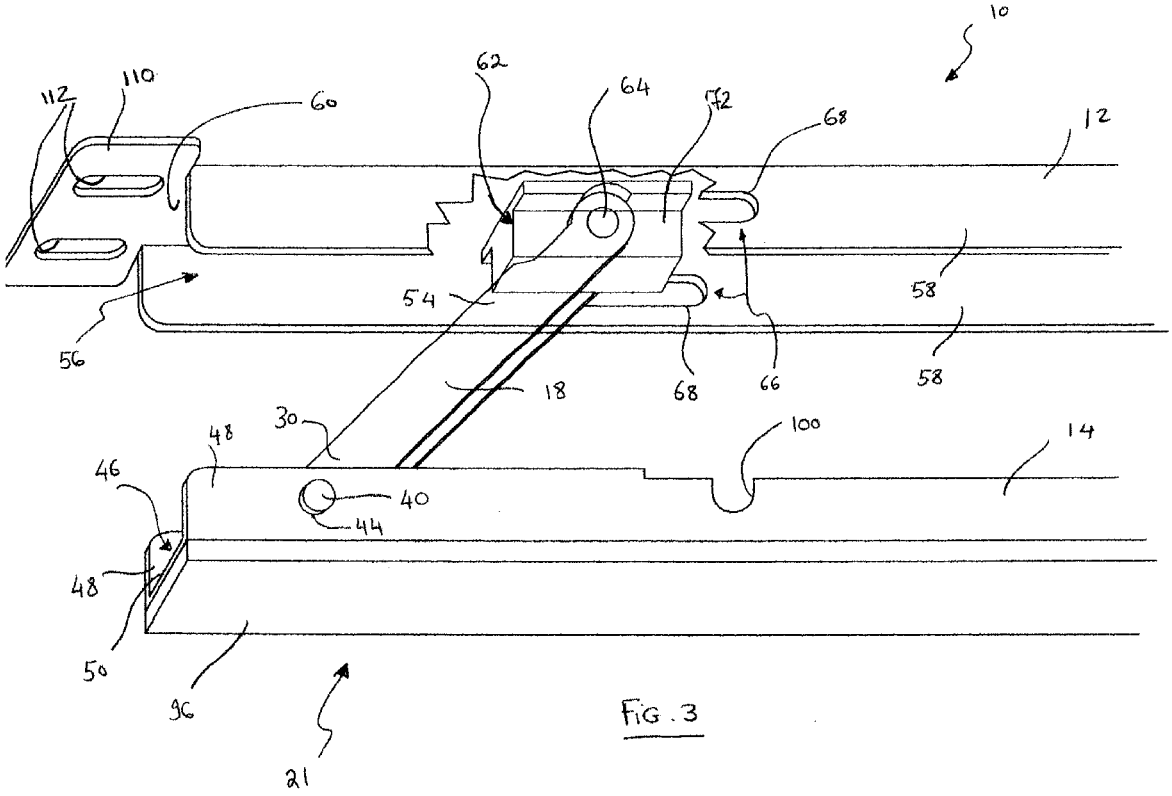
FIG. 3 is a view similar to a mirror image of FIG. 2 showing a sliding mechanism according to a preferred embodiment of the present invention.

Referring now to FIG. 3, a portion of presser assembly 10 adjacent second end 21 of presser rail 14 is shown. Similar to FIG. 2, descriptions regarding FIG. 3 and pertaining to portions of the presser assembly adjacent second end 21 of presser rail 18 apply equally to the portions of the presser assembly adjacent first end 20 of presser rail 16. As shown in FIG. 3, according to a preferred embodiment of the present invention, the support rail 12 is an elongated member defining a trough 56 therein, the first connecting rail 16 and the second connecting rail 18 each being slidably guidable within the trough at support ends thereof. Trough 56 is defined between parallel sidewalls 58 and top wall 60 of the support rail 12.

Support ends 52 and 54 of connecting rails 16 and 18 are preferably made slidably guidable in trough 56 by providing at least one guide groove in support rail 12 according to the present invention. Additionally, a sliding mechanism 62 is provided for effecting a sliding of the support ends of the first connecting rail and the second connecting rail within the trough 56. The sliding mechanism preferably includes a guide pin 64 extending through a respective support end 52 or 54. As shown in FIG. 3, the pins 64 are slidably guidable within the at least one guide groove, as will be explained in further detail below.

According to the shown preferred embodiment of the present invention in FIG. 3, the at least one guide groove includes two pairs of grooves 66, one pair of which is shown in FIG. 3. A first pair of the two pairs of grooves is preferably disposed adjacent the support end 52 of the first connecting rail 16, and is configured for guiding one of the guide pins 64 therein. The second pair 66 of the two pairs is preferably disposed adjacent the support end 54 of the second connecting rail 18 and is configured for guiding the other one of the guide pins 64 therein. Each pair 66 of guide grooves more preferably includes two opposite and facing elongated holes, grooves, or slots 68, each defined in a respective sidewall 58 of the support rail 12. Referring now to both FIGS. 1 and 3, as the connecting rails 16 and 18 are pivoted so as to reduce angle $\alpha$ and reduce default distance D, each guide pin 64 slides forward in its corresponding slot 68, with each lateral part of each slot 68 serving as a stop for its corresponding guide pin. Therefore, in a default mode of the connecting rails, outer edges 70 of each slot 68 determine a stopping position of each connecting rail as it is biased outward, as readily recognizable by one skilled in the art.

Referring back to FIG. 3, the sliding mechanism 62 further preferably includes a glide support 72 for each of the connecting rails 16 and 18, the glide support for connecting rail 18 being shown in FIG. 3. The glide support in the preferred embodiment of the present invention is connected to the support ends 52 and 54 of the first connecting rail 16 and the second connecting rail 18, respectively. Each glide support 72 is further configured to be guided within the trough 56 for slidably guiding the support ends in the trough.

Figure 4:
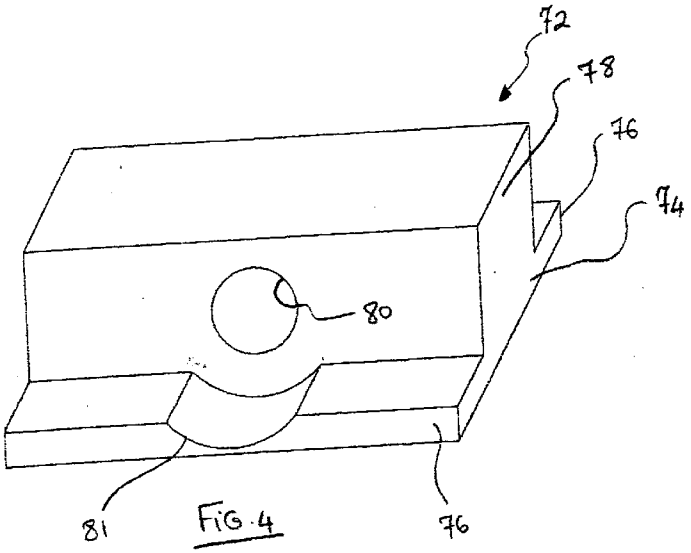
FIG. 4 is a perspective view of a glide support according to a preferred embodiment of the present invention.

FIG. 4 depicts a perspective view of a preferred embodiment of a glide support 72 according to the present invention. As seen in FIG. 4, each glide support 72 includes an extended base portion 74 having side edges 76, and a narrowed head portion 78 defining a hole 80 therein for each guide pin 64. The glide support further preferably defines curved recesses 81 on each side thereof at a central region of its base portion for accommodating a pivoting motion of a corresponding end of a connecting rail. Thus, as readily recognizable by one skilled in the art, and as seen in FIG. 3, each connecting rail is connected to its corresponding glide support 72 by being fastened thereto by way of guide pin 64 extending through hole 80 (FIG. 4) of the glide support. Each glide support rests within the trough 56, its side edges 76 substantially abutting the inner surfaces of sidewalls 58 of support rail 12. Thus, each glide support 72 is slidably guided within trough 56, in turn slidably guiding each support end of each connecting rail with respect to the support rail.

Figure 5A:
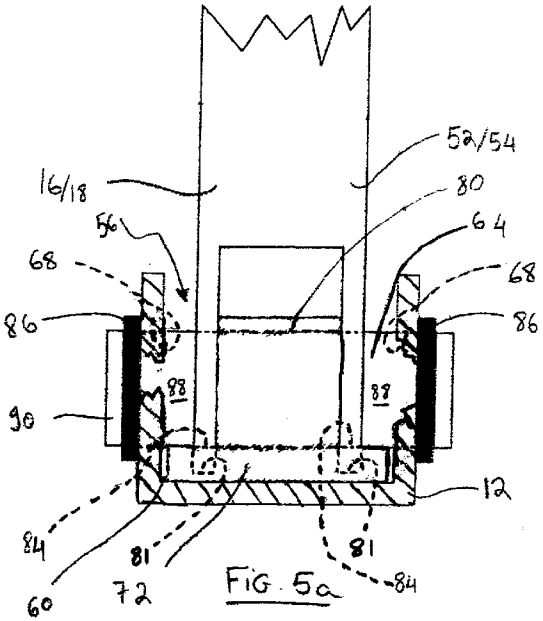
FIG. 5*a* is a view of a support end of one of the connecting rails of FIG. 1 shown connected to the support rail with the connecting rail in cross-section and partial cutaway.
Figure 5B:
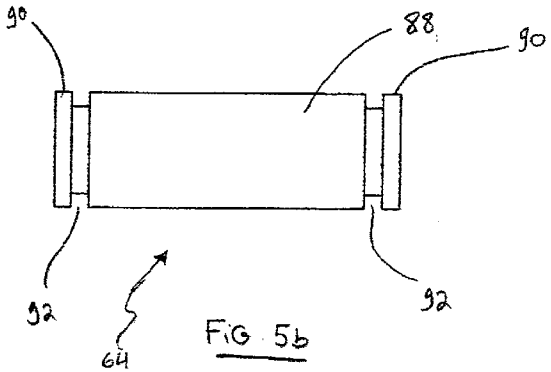
FIG. 5*b* is a front-elevational view of the guide pin shown in FIG. 5*a* according to a preferred embodiment of the present invention.
Figure 5C:
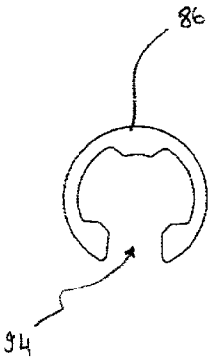
FIG. 5*c* is a front-elevational view of one of the locking rings shown in FIG. 5*a* according to a preferred embodiment of the present invention.

Referring now to FIGS. 5*a* through 5*c*, connecting parts for connecting the support end of each connecting rail to its glide support and to the support rail are shown. As seen in FIG. 5*a*, a cross section of the portion of each support end 52, 54 of each connecting rail 16, 18 connected to the support rail 12 is shown in a plane transverse to the longitudinal direction of the support rail. Pin 64 extends through the slots 68 in the support rail, through corresponding holes 84 in the support end 52/54, and through hole 80 in each glide support 72 as shown. Each pin 64 is held in position by a pair of locking rings 86.

Referring now to FIG. 5*b*, a side view of a preferred embodiment of a guide pin 64 is shown. The guide pin preferably has a body portion 88 adapted to extend within trough 56 of support rail 12, and end portions 90. Guide pin 64 defines recesses 92 between each end portion 90 and the body portion 88 for accommodating a respective locking ring 86 (FIG. 5*c*) therein. As seen in FIG. 5*c*, the locking ring 86 is preferably substantially annular, and defines an opening 94 adapted to be snapped onto a corresponding recess 92 of the guide pin 64. The above arrangement ensures a secure slidable guiding connection between each connecting rail and the support rail. Preferably, a lubricant (not shown) is disposed in the trough for lubricating a sliding motion of each glide support within the trough. The lubricant may be disposed on top surface 60 of the support rail 12, at the underside of each glide support, and preferably along top surface 60 along the entire sliding path of each glide support.

As seen in FIGS. 1 through 3, the presser assembly according to the present invention preferably includes a rubber pad 96 fixed to a lower surface of the presser rail 14 for frictionally engaging a scrap thereunder during the blanking operation. Preferably, the presser rail further defines two pairs of facing recesses 100 therein. As best seen in FIG. 2, each pair of the two pairs of recesses includes a first recess 100 in one sidewall 48 of the presser rail and a second recess 100 in another, facing sidewall 48 of the presser rail 14, the recesses of each pair being in registration in a direction transverse to a longitudinal direction of the presser rail 14. As seen in FIG. 1, the recesses of each pair are preferably spaced from one another such that, in a fully folded state of the presser assembly, the support rail 12, the connecting rail and the presser rail are substantially parallel to one another, and the first guide pin 64 and the second guide pin 64 are each received in a respective one of the two pairs of recesses 100 for allowing the presser assembly to fold fully with the presser rail 14 fitting almost fully within the groove 56 of support rail 12.

As shown in FIGS. 1 through 3, the preferred embodiment of the presser assembly according to the present invention includes two assembly flanges 110, one flange on each end of the support rail 12. As seen in FIG. 2, each flange includes one or more through holes 112 therein for allowing a fastening of the presser assembly to a male blanker board.

Optionally, a pair of resting pads 98, as seen in FIG. 1, are provided on bottom wall 50 of the presser rail, each of the pads 98 being disposed at a respective one of the first end 20 and the second end 21 of the presser rail such that, in a default mode of the first connecting rail and the second connecting rail as shown in FIG. 1, a tip of the presser end of each of the first connecting rail and the second connecting rail rests against a corresponding one of the resting pads. The resting pads advantageously prevent a scratching of the bottom wall 50 of the presser rail 14 by the tip of the presser ends of the connecting rails 16 and 18.

Preferably, according to the present invention, at least the support rail, presser rail, and connecting rails are made of steel or aluminum, and are die punched for rigidity. The glide supports are in turn preferably made of a hard, durable plastic, preferably a slidable plastic such as polytetrafluoroethylene or another fluoropolymer.

As can be appreciated from the figures, the connecting rails are configured for effecting a folding of the presser assembly such that, in a fully folded state of the presser assembly, the support rail, the connecting rail and the presser rail are substantially parallel to one another. Advantageously, the invention provides a presser assembly that is easy to install on male blanker boards and that, by virtue of its simple construction, is easily manufactured, is generally less costly to manufacture than presser assemblies of the prior art, and is removed from male blanker boards of blanking devices with ease for being changed or reused. Furthermore, the presser assembly according to the present invention maintains the advantages of prior art presser assemblies, such as the ability to adjust to unequal pressure on the assembly, while substantially eliminating a possibility that the assembly will jam, as happens with presser assemblies of the prior art using guide cylinders. Additionally, the presser assembly according to a preferred embodiment of the present invention, unlike the presser assemblies of the prior art, does not require height adjustment, and thus can be much more efficiently mounted onto male blanker boards. Typically, the presser assembly according to a preferred embodiment of the present invention may be mounted in two to three minutes, while the presser assemblies of the prior art typically require adjustment of assembly lasting from two to three hours.

The present invention further includes a kit for forming a presser assembly for supporting blanking scrap during a blanking operation. The kit according to the present invention includes: a support rail, such as support rail 12; a presser rail, such as presser rail 14 adapted to be connected to the support rail; and a connecting rail adapted to connect the presser rail to the support rail and adapted to pivot with respect to at least one of the support rail and the presser rail in an assembled state of the presser assembly through a predetermined pivot angle range for changing a distance between the support rail and the presser rail. A reduction of the distance between the support rail and the presser rail, such as of the distance D shown in FIG. 1, effects a folding of the presser assembly during the blanking operation. The kit according to the present invention encompasses the components of the presser assembly adapted to be connected to one another for forming the presser assembly. Thus, the kit includes, in a preferred embodiment of the present invention, the first connecting rail 16 and the second connecting rail 18 adapted to connect the presser rail 14 to the support rail 12, respectively, at the first end 20 and at the second end 21 thereof. The kit according to the preferred embodiment of the present invention further includes the biasing mechanism 26, which in turn includes the torsion spring 32.

In operation, as readily recognizable by one skilled in the art, the support rail 12 may be pushed toward the presser rail 14 for pivoting the connecting rails 16 and 18 with respect to at least one of the support rail and the presser rail for reducing angle $\alpha$ thereby folding the presser assembly for reducing a distance between the presser rail and the support rail. For unfolding the presser assembly, the method according to the present invention includes the step of pivoting the connecting rails 16 and 18 with respect to at least one of the support rail and the presser rail for increasing angle $\alpha$ defined therebetween, thereby unfolding the presser assembly for increasing a distance between the presser rail and the support rail. For achieving a fully folded state of the presser assembly, the method according to the present invention includes the step of pivoting the connecting rail for achieving a fully folded state of the presser assembly wherein the support rail, the connecting rail and the presser rail are substantially parallel with respect to one another, and preferably such that the presser rail almost fully rests within a groove of the support rail.

The present invention further includes within its scope a presser assembly for supporting blanking scrap during a blanking operation, the presser assembly including: a support means; a presser means connected to the support means and supported thereby; and a connecting means for connecting the presser rail to the support rail and being adapted to pivot with respect to the presser rail through a predetermined pivot angle range for changing a distance between the presser rail and the support rail thereby selectively effecting a folding and an unfolding of the presser assembly during the blanking operation. The means mentioned above are substantially shown and described in relation to FIGS. 1 through 6.

It will be apparent to those skilled in the art that the disclosed invention may be modified in numerous ways and may assume many embodiments other than the preferred forms specifically set out and described above. Accordingly, it is intended by the appended claims to cover all modifications of the invention that fall within the true spirit and scope of the invention.

What is claimed is:

1. A presser assembly for supporting blanking scrap during a blanking operation, the presser assembly comprising:

a support rail;

a presser rail connected to the support rail; and a connecting rail connecting the presser rail to the support rail and being adapted to pivot with respect to at least one of the support rail and the presser rail through a predetermined pivot angle range for changing a distance between the support rail and the presser rail thereby selectively effecting a folding and an unfolding of the presser assembly during the blanking operation, and a biasing mechanism for biasing the presser rail away from the support rail.

2. The presser assembly according to claim 1, wherein:

the presser rail is connected to the support rail respectively at a first end and at a second end thereof, the connecting rail comprises a first connecting rail and a second connecting rail connecting the presser rail to the support rail respectively at the first end and at the second end thereof, the first connecting rail and the second connecting rail each being adapted to independently pivot with respect to at least one of the support rail and the presser rail for changing a distance between the support rail and the presser rail thereby folding the presser assembly during the blanking operation.

3. The presser assembly according to claim 2, wherein:

each of the first connecting rail and the second connecting rail has a presser end and a support end; and the biasing mechanism comprises a torsion spring disposed at at least one of the presser end and the support end of at least one of the first connecting rail and the second connecting rail.

4. The presser assembly according to claim 3, wherein the torsion spring includes a first torsion spring and a second torsion spring disposed at the presser end of the first connecting rail and at the presser end of the second connecting rail, respectively.

5. The presser assembly according to claim 3, wherein the biasing mechanism further includes a first pin and a second pin respectively extending through the presser ends of the first connecting rail and the second connecting rail for pivotally securing the first connecting rail and the second connecting rail to the presser rail.

6. The presser assembly according to claim 2, wherein the first connecting rail and the second connecting rail extend, in a default mode thereof, at an angle of about 45 degrees between the support rail and the presser rail.

7. The presser assembly according to claim 2, wherein the presser rail is an elongated member defining a trough therein, the first connecting rail and the second connecting rail each having a presser end and a support end and further being pivotally connected to the presser rail such that presser ends thereof are disposed in the trough.

8. The presser assembly according to claim 2, wherein the support rail is an elongated member defining a trough therein, the first connecting rail and the second connecting rail each having a presser end and a support end and further being slidably guidable within the trough at support ends thereof.

9. The presser assembly according to claim 8, wherein the support rail defines at least one guide groove therein, the presser assembly further comprising a sliding mechanism for effecting a sliding of the support ends of the first connecting rail and the second connecting rail within the trough, the sliding mechanism including a first guide pin and a second guide pin extending through the support ends of the first connecting rail and the second connecting rail respectively and further being slidably guided within the at least one guide groove.

10. The presser assembly according to claim 9, wherein the at least one guide groove includes two pairs of grooves, a first pair of the two pairs being disposed adjacent the support end of the first connecting rail and being configured for guiding the first guide pin therein, and the second pair of the two pairs being disposed adjacent the support end of the second connecting rail and being configured for guiding the second guide pin therein.

11. The presser assembly according to claim 9, wherein the sliding mechanism further includes a first glide support and a second glide support connected to the support ends of the first connecting rail and the second connecting rail, respectively, each glide support being configured to be guided within the trough for slidably guiding the support ends in the trough.

12. The presser assembly according to claim 11, further comprising a lubricant disposed in the trough for lubricating a sliding motion of each glide support within the trough.

13. The presser assembly according to claim 9, further comprising a plurality of locking rings for slidably locking the first guide pin and the second guide pin within the at least one groove.

14. The presser assembly according to claim 13, wherein the plurality of locking rings comprises two pairs of locking rings, each pair slidably locking a respective one of the first guide pin and the second guide pin within the at least one groove.

15. The presser assembly according to claim 9, wherein the presser rail defines two pairs of facing recesses therein, each pair of the two pairs including a first recess in one sidewall of the presser rail and a second recess in another, facing sidewall of the presser rail, recesses of each pair being in registration in a direction transverse to a longitudinal direction of the presser rail, the two pairs of recesses being spaced from one another such that, in a fully folded state of the presser assembly, the support rail, the connecting rail and the presser rail are substantially parallel to one another, and the first guide pin and the second guide pin each are received in a respective one of the two pairs of recesses.

16. The presser assembly according to claim 2, further comprising a pair of resting pads, each of the pads being disposed at a respective one of the first end and the second end of the presser rail such that, in a default mode of the first connecting rail and the second connecting rail, a tip of the presser end of each of the first connecting rail and the second connecting rail rests against a corresponding one of the resting pads.

17. The presser assembly according to claim 1, wherein the biasing mechanism is coupled to at least one of two ends of the connecting rail.

18. The presser assembly according to claim 17, wherein the biasing mechanism comprises a torsion spring.

19. The presser assembly according to claim 1, further comprising a rubber pad fixed to a lower surface of the presser rail for frictionally engaging a scrap thereunder during the blanking operation.

20. The presser assembly according to claim 1, wherein the connecting rail is configured for effecting a folding of the presser assembly such that, in a fully folded state of the presser assembly, the support rail, the connecting rail and the presser rail are substantially parallel to one another.

21. A kit for forming a presser assembly for supporting blanking scrap during a blanking operation, the kit comprising:

a support rail;

a presser rail adapted to be connected to the support rail; and a connecting rail adapted to connect the presser rail to the support rail and adapted to pivot with respect to at least one of the support rail and the presser rail in an assembled state of the presser assembly through a predetermined pivot angle range for changing a distance between the support rail and the presser rail thereby selectively effecting a folding and an unfolding of the presser assembly during the blanking operation; and a biasing mechanism for biasing the presser rail away from the support rail.

22. The kit according to claim 21, wherein:

the presser rail is adapted to be connected to the support rail respectively at a first end and at a second end thereof;

the connecting rail comprises a first connecting rail and a second connecting rail adapted to connect the presser rail to the support rail respectively at the first end and at the second end thereof, the first connecting rail and the second connecting rail each being adapted to independently pivot with respect to at least one of the support rail and the presser rail in an assembled state of the presser assembly for changing a distance between the support rail and the presser rail thereby folding the presser assembly during the blanking operation.

23. The kit according to claim 21, wherein the biasing mechanism is adapted to be coupled to at least one of two ends of the connecting rail.

24. The kit according to claim 23, wherein the biasing mechanism comprises a torsion spring.

25. A method comprising the steps of:

providing the presser assembly of claim 1;

pivoting the connecting rail with respect to at least one of the support rail and the presser rail for reducing an angle defined therebetween thereby folding the presser assembly for reducing a distance between the presser rail and the support rail; and pivoting the connecting rail with respect to at least one of the support rail and the presser rail for increasing an angle defined therebetween thereby unfolding the presser assembly for increasing a distance between the presser rail and the support rail.

26. The method according to claim 25, wherein the step of pivoting the connecting rail with respect to the presser rail for reducing includes the step of pivoting the connecting rail for achieving a fully folded state of the presser assembly wherein the support rail, the connecting rail and the presser rail are substantially parallel with respect to one another.

27. A presser assembly for supporting blanking scrap during a blanking operation, the presser assembly comprising:

a support means;

a presser means connected to the support means and supported thereby; and a connecting means for connecting the presser rail to the support rail and being adapted to pivot with respect to the presser rail through a predetermined pivot angle range for changing a distance between the presser rail and the support rail thereby selectively effecting a folding and an unfolding of the presser assembly during the blanking operation; and a biasing means for biasing the presser rail away from the support rail.

* * * * *